United States Patent [19]

McGinnis

[11] Patent Number: 4,694,630

[45] Date of Patent: Sep. 22, 1987

[54] TOWER AND METHOD OF CONSTRUCTING A TOWER

[76] Inventor: Henry J. McGinnis, 7241 Martha La., Fort Worth, Tex. 76111

[21] Appl. No.: 825,206

[22] Filed: Feb. 3, 1986

[51] Int. Cl.[4] ..... E04H 12/00

[52] U.S. Cl. ..... 52/649; 52/655

[58] Field of Search ..... 52/648, 649, 146–150, 52/745, 720, 721, 654, 655

[56] References Cited

U.S. PATENT DOCUMENTS

Re. 12,842 8/1908 Noyes ..... 52/649

FOREIGN PATENT DOCUMENTS 783456 2/1979 U.S.S.R. ..... 52/649

OTHER PUBLICATIONS

"World's Third Tallest Structure Erected in Greenland" by S. D. Sturgis, Jr., *Civil Engineering,* 6–1954.

*Primary Examiner*—Carl D. Friedman
*Assistant Examiner*—Naoko N. Slack
*Attorney, Agent, or Firm*—James E. Bradley

[57] ABSTRACT

A tower and a method of constructing a tower. The tower has three support members and an upper member. Each support member has an outside leg and two inside legs, laced together in a triangular cross section. The upper end of each inside leg is attached to the upper end of one of the other inside legs. The inside legs may also be connected at an intermediate point to form a window. An upper member, having three legs, laced together to form a triangular cross section, is erected on top of the support members, so that the legs of the upper member extend upward from the outside legs of the support members.

6 Claims, 6 Drawing Figures

TOWER AND METHOD OF CONSTRUCTING A TOWER

BACKGROUND OF THE INVENTION

1. Field of the Invention

This invention relates in general to the field of towers and methods of constructing towers. In particular, the invention relates to self-supporting towers and methods of constructing such towers.

2. Description of the Prior Art

In the past, self-supporting towers have had three or four legs, laced together to form a triangular or rectangular cross section. The distance between the legs is proportional to the height of the tower. If a tower is very tall, then the legs must be very far apart.

When the legs are far apart, lacing members between the legs are very long. When the lacing members are very long, they must also be very large. Otherwise, wind will cause the lacing members to vibrate excessively. To reduce vibration of the lacing members, the lacing members must be made much larger than is necessary to carry the load.

SUMMARY OF THE INVENTION

The tower of the invention is a strong, sturdy tower, and yet the lacing members not very long. The tower has an upper member, erected on top of three structural support members, or trusses. The lacing members are much shorter, because the lacing members do not have to extend between the support members.

Each of the three support members has an outside leg and two inside legs. The three legs are laced together to form a triangular cross section. The three support members are connected together by attaching the top of each inside leg to the top of an inside leg on one of the other support members. Each pair of inside legs may also be attached at an intermediate point, to form a window.

The upper member, which also has three legs, is then laced together to form a triangular cross section. The upper member is erected on top of the three support members, so that the three legs of the upper member extend upward from the three outside legs of the support members.

DESCRIPTION OF THE PREFERRED EMBODIMENT

Figure 1:
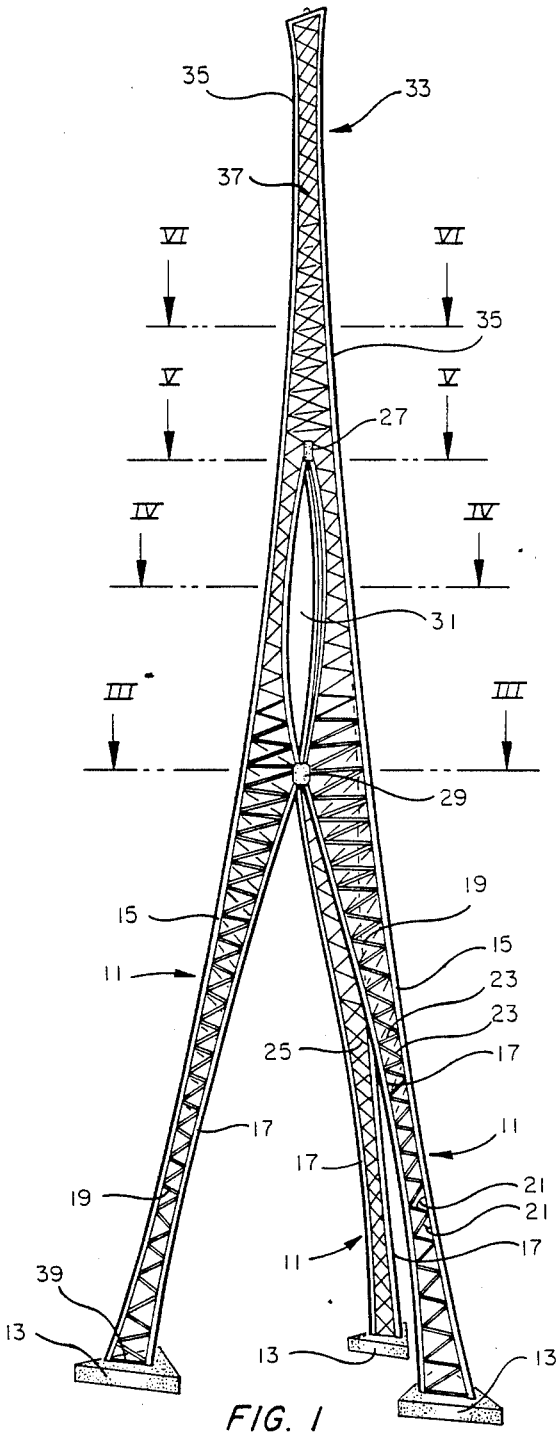
FIG. 1 is a perspective view of the tower of the invention.
Figure 2:
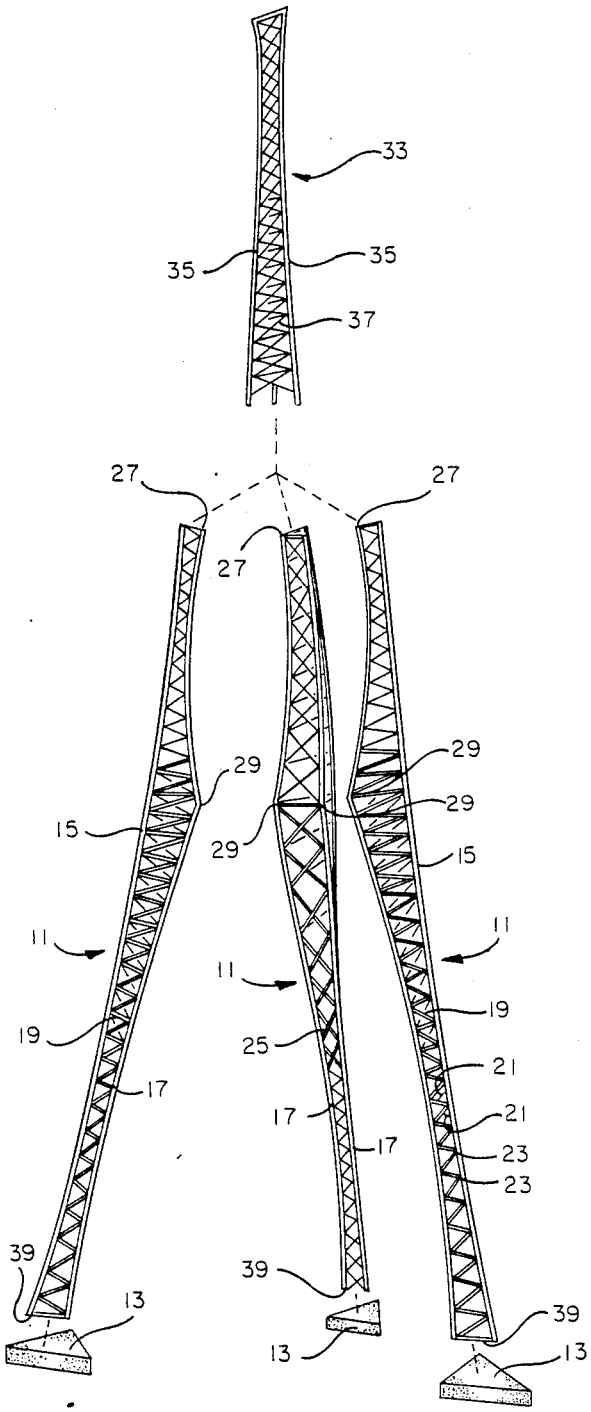
FIG. 2 is an exploded view of the tower of the invention.
Figure 6:
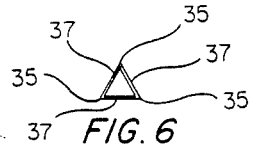
FIG. 6 is a sectional view of the tower of the invention, as seen along lines VI—VI in FIG. 1.
Figure 5:
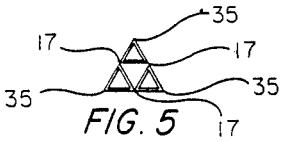
FIG. 5 is a sectional view of the tower of the invention, as seen along lines V—V in FIG. 1.

The tower of the invention has three support members 11, mounted on three bases 13, as shown in FIGS. 1 and 2. Each support member 11 a truss, having an outside leg 15 and two inside legs 17.

Lacing members 19 secure each inside leg 17 to one of the outside legs 15. In one embodiment of the tower, the angles 21 between the outside leg 15 and the lacing members 19 are equal. In another embodiment, the lacing members 19 are connected to the outside leg 15 at connection points 23 which are a constant distance apart.

Figure 4:
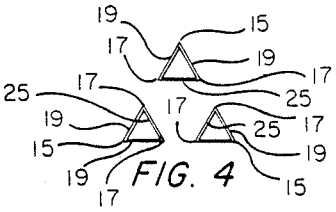
FIG. 4 is a sectional view of the tower of the invention, as seen along lines IV—IV in FIG. 1.
Figure 3:
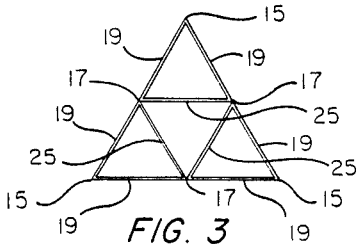
FIG. 3 is a sectional view of the tower of the invention, as seen along lines III—III in FIG. 1.

The two inside legs 17 of each support member 11 are tied together with diagonals 25. In some cases, the diagonals 25 may be augmented with horizontal struts. The support members 11 have a triangular cross section, as shown in FIGS. 3 and 4.

The upper end 27 of each inside leg 17 is attached to the upper end 27 of one of the inside legs 17 of one of the other support members 11. Each pair of inside legs 17 is also attached at an intermediate point 29, forming a window 31 between each pair of support members 11. In extremely tall towers, the inside legs 17 may be connected at additional points, forming additional windows.

An upper member 33, having three legs 35, is erected on top of the three support members 11. The three legs 35 of the upper member 33 are laced together with lacing members 37. The three legs 35 extend upward from the outside legs 15 of the support members 11.

The legs 35 of the upper member 33 and the inside and outside legs 15, 17 of the support members 11 are made out of straight pieces of steel. As the legs 15, 17, 35 are laced together, the steel is forced into the curved shape shown in the drawings. The exact curvature of the legs 15, 17, 35 is determined by the various lengths of the lacing members 19, 37.

The method of the invention begins with the step of lacing together an outside leg 15 and two inside legs 17 to construct a support member 11 with a triangular cross section. This step is then repeated twice to construct two additional support members 11. The three support members 11 are then erected, so that the lower end 39 of each support member 11 is on a base 13. The upper ends 27 of the inside legs 17 are then bolted together.

Three legs 35 are laced together to construct an upper member 33, having a triangular cross section. The upper member 33 is erected on top of the support members 11, so that each leg 35 of the upper member 33 is connected to one of the outside legs 15 of the support members 11.

The method of constructing the tower may include lacing the outside leg 15 and the inside legs 17 together with lacing members 19, wherein the angles 21 between the lacing members 19 and the outside leg 15 are equal. In another embodiment, the method includes connecting the lacing members 19 to the outside leg 15 at connection points 23 which are a constant distance apart.

The tower and method of the invention have several advantages over the prior art. It is unnecessary to make the lacing members 19 very large, because the lacing members 19 do not have to extend between the support members 11. The curvature of the legs 15, 17, 35 further reduces the necessary length and size of the lacing members 19, 37.

Total construction time is reduced, because the three support members 11 and the upper member 33 can be constructed separately. Also, the support members 11 and the upper member 33 can be constructed on the ground, and then lifted into position. The method of the invention is also safer, because it reduces the time during which a worker must be high up on the tower, making connections between the various members.

When the angles 21 betwen the lacing members 19 and the outside leg 15 are kept equal, the bolt pattern is constant, making it easier to make the connections. If the distance between connection points 23 is kept constant, then less material is lost when the pieces of the outside leg 15 are cut.

The invention has been shown in only one of its forms. It should be apparent to those skilled in the art that it is not so limited, but is susceptible to various changes and modifications without departing from the spirit thereof.

I claim:

1. A tower, comprising:

a base section and a window section extending upward from the top of the base section;

each section having a plurality of columns, each column having an outside leg and two inside legs, laced together in a triangular cross-section throughout the length of each section;

the width of each column in the window section varying along the length of the window section, from larger widths at the top and bottom of the window section to a minimum width area between the top and bottom of the window section;

the columns being spaced apart at the bottom of the base section, converging upward and joining each other at the top of the base section; and the columns in the window section joining each other at the bottom of the window section, separating from each other between the top and bottom of the window section, and joining again at the top of the window section, defining an open window between the columns in the window section.

2. The tower according to claim 1 wherein in the window section, the outside legs converge toward each other from the bottom to the top of the window section, and the inside legs of each column converge toward the inside legs of the other columns from the minimum width area to the top of the window section and at a greater rate of convergence than the outside legs.

3. The tower according to claim 1 wherein each of the windows is generally elliptical in configuration.

4. The tower according to claim 1 wherein in the base section, each inside leg of each column joins an inside leg of an adjacent column in side by side contact at the top of the base section.

5. A tower, comprising:

a base section and a window section extending upward from the top of the base section, each section having a plurality of columns, each column having an outside leg and two inside legs, laced together in a triangular cross-section throughout the lengths of the sections;

the outside legs of each column in each section continuously converging toward each other from the bottom of the base section to the top of the window section;

the inside legs of the base section columns being spaced apart from the inside legs of adjacent base section columns at the bottom of the base section and being joined to each other at the top of the base section;

the widths of the columns from the inside legs to the outside legs varying along the lengths of the base section and the window section, from larger widths at the bottom and top of each section to a minimum width area between the top and bottom of each section; and each inside leg of each column being joined to an inside leg of an adjacent column at the bottom and the top of the window section and separating therebetween to define a generally elliptical window between each outside leg.

6. A tower, comprising:

a base section and a window section extending upward from the top of the base section, each section having a plurality of columns, each column having an outside leg and two inside legs, laced together in a triangular cross-section throughout the lengths of the sections;

the outside legs of each column in each section converging toward each other from the bottom of the base section to the top of the window section;

the inside legs of each base section column being spaced apart from the inside legs of adjacent base section columns at the bottom of the base section and converging in a generally curved shaped line to the top of the base section, where each inside leg is joined to an inside leg of an adjacent column;

the widths of the columns from the inside legs to the outside legs varying along the lengths of the base section and the window section, from larger widths at the bottom and top of each section to a minimum width area between the top and bottom of each section; and each inside leg of each column being joined to an inside leg of an adjacent column in side by side relation at the bottom of the window section, then extending apart from each other in a generally curved shaped line and converging back to each other where, at the top of the window section, the inside legs are again joined to each other in side by side relation, defining a generally elliptical shaped open window between each column.

* * * * *